US006849010B1

(12) United States Patent
Valdeus, Jr.

(10) Patent No.: US 6,849,010 B1
(45) Date of Patent: Feb. 1, 2005

(54) HANET BALL GAME AND METHOD

(76) Inventor: Fritz Valdeus, Jr., 2825 SW. 22nd Ave. #205, Delray Beach, FL (US) 33445

( * ) Notice: Subject to any disclaimer, the term of this patent is extended or adjusted under 35 U.S.C. 154(b) by 131 days.

(21) Appl. No.: 10/317,753

(22) Filed: Dec. 11, 2002

(51) Int. Cl.[7] ..... A63B 61/00; A63B 67/00
(52) U.S. Cl. ..... 473/469; 473/470
(58) Field of Search ..... 473/470, 471, 473/476, 415, 197, 465; 472/197, 92; D21/48, 699, 705, 706; 256/1; 217/74, 91, 122; D11/143

(56) References Cited

U.S. PATENT DOCUMENTS 4,792,144 A * 12/1988 LaDue ..... 473/471
6,629,899 B2 * 10/2003 Chauvet et al. ..... 473/472

OTHER PUBLICATIONS

"Soccer," Rules of the Game. New York: Paddington Press Ltd., copyright 1974, pp. 160–163.*

"American Gladiators," Game FAQs, dated Nov. 1, 1999.*

* cited by examiner

*Primary Examiner*—Gregory Vidovich
*Assistant Examiner*—Alvin A. Hunter, Jr.

(57) ABSTRACT

A hanet ball game and method comprises an elongated rectangular playing field having two opposite ends. A ground standing tubular goal net at both ends of the playing field. The goal net is approximately 12 feet in diameter and 3½ feet tall and has a goalkeeper playing within it. Two teams of five to seven players attempt to get the ball into the opponents goal net.

5 Claims, 2 Drawing Sheets

HANET BALL GAME AND METHOD

BACKGROUND OF THE INVENTION

1. Field of the Invention

The present invention relates to a hanet ball game and method for use in connection with athletic games. The hanet ball game and method has particular utility in connection with unique field type game.

2. Description of the Prior Art

Hanet ball game and methods are desirable as a new fast paced field type game for the sports enthusiast.

The use of athletic games is known in the prior art. For example, U.S. Pat. No. 4,482,157 to McNeil discloses a tip ball game that is a game which is a combination of basic basketball, football, volleyball and soccer. This combination is so designed to show the beauty of each sport as well as providing recreational exercise. Total athletic skills are displayed in the game and more people are given the chance to participate since it is so designed that a small person can participate as well as a large person. However, the McNeil '157 patent does not have a round field goal.

Similarly, U.S. Pat. No. 3,865,371 to Theriot discloses a game comprising an elongated rectangular playing field and a vertical net secured to the field and extending transversely across the middle thereof to divide the field in half. A smaller rectangular area centered on the field and divided in half by the nets and first and second elevated ball receiving baskets. Each basket is disposed in a corresponding half of the field area. However, the Theriot '371 patent does not have a round field goal.

Lastly, U.S. Pat. No. 5,207,433 to Moore discloses a football game, apparatus and method of play that relates to a variation of the traditional American football game concentrating on the passing aspects which demands virtually all of the athletic skills of traditional football, but capable of being played by a minimal number of players, preferably varying from three to five players. The subject game including new apparatus and method of playing employs a number of the refinements of the professional football passing game, based upon its timing and spacing aspects to provide a real athletic challenge, which game may be played on a smaller field, on both inside and outside facilities, the playing field consisting of a level open space at least 40 yards long and 30 yards wide. Spaced-apart markers are used to designate the offensive receiver positions for thrown passes and varied defensive alignments to prevent successful passing into a plurality of stationary nets or baskets. However, the Moore '433 patent does not have a round field goal.

While the above-described devices fulfill their respective, particular objectives and requirements, the aforementioned patents do not describe a hanet ball game and method that allows unique field type game. The McNeil '157, Theriot '371 and Moore '433 patents make no provision for have a round field goal.

Therefore, a need exists for a new and improved hanet ball game and method which can be used for unique field type game. In this regard, the present invention substantially fulfills this need. In this respect, the hanet ball game and method according to the present invention substantially departs from the conventional concepts and designs of the prior art, and in doing so provides an apparatus primarily developed for the purpose of unique field type game.

SUMMARY OF THE INVENTION

In view of the foregoing disadvantages inherent in the known types of athletic games now present in the prior art, the present invention provides an improved hanet ball game and method, and overcomes the above-mentioned disadvantages and drawbacks of the prior art. As such, the general purpose of the present invention, which will be described subsequently in greater detail, is to provide a new and improved hanet ball game and method and method which has all the advantages of the prior art mentioned heretofore and many novel features that result in a hanet ball game and method which is not anticipated, rendered obvious, suggested, or even implied by the prior art, either alone or in any combination thereof.

To attain this, the present invention essentially comprises an elongated rectangular playing field having two opposite ends. A ground standing tubular goal net at both ends of the playing field. The goal net is approximately 12 feet in diameter and 3½ feet tall and has a goal keeper playing within it. Two teams of five to seven players attempt to get the ball into the opponent's goal net.

There has thus been outlined, rather broadly, the more important features of the invention in order that the detailed description thereof that follows may be better understood and in order that the present contribution to the art may be better appreciated.

The invention may also include a circular frame and a perimeter wall. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hanet ball game and method that has all of the advantages of the prior art athletic games and none of the disadvantages.

It is another object of the present invention to provide a new and improved hanet ball game and method that may be easily and efficiently manufactured and marketed.

An even further object of the present invention is to provide a new and improved hanet ball game and method that has a low cost of manufacture with regard to both materials and labor, and which accordingly is then susceptible of low prices of sale to the consuming public, thereby making such hanet ball game and method economically available to the buying public.

Still another object of the present invention is to provide a new hanet ball game and method that provides in the apparatuses and methods of the prior art some of the advantages thereof, while simultaneously overcoming some of the disadvantages normally associated therewith.

Lastly, it is an object of the present invention is to provide a hanet ball game and method that utilizes a round field goal.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
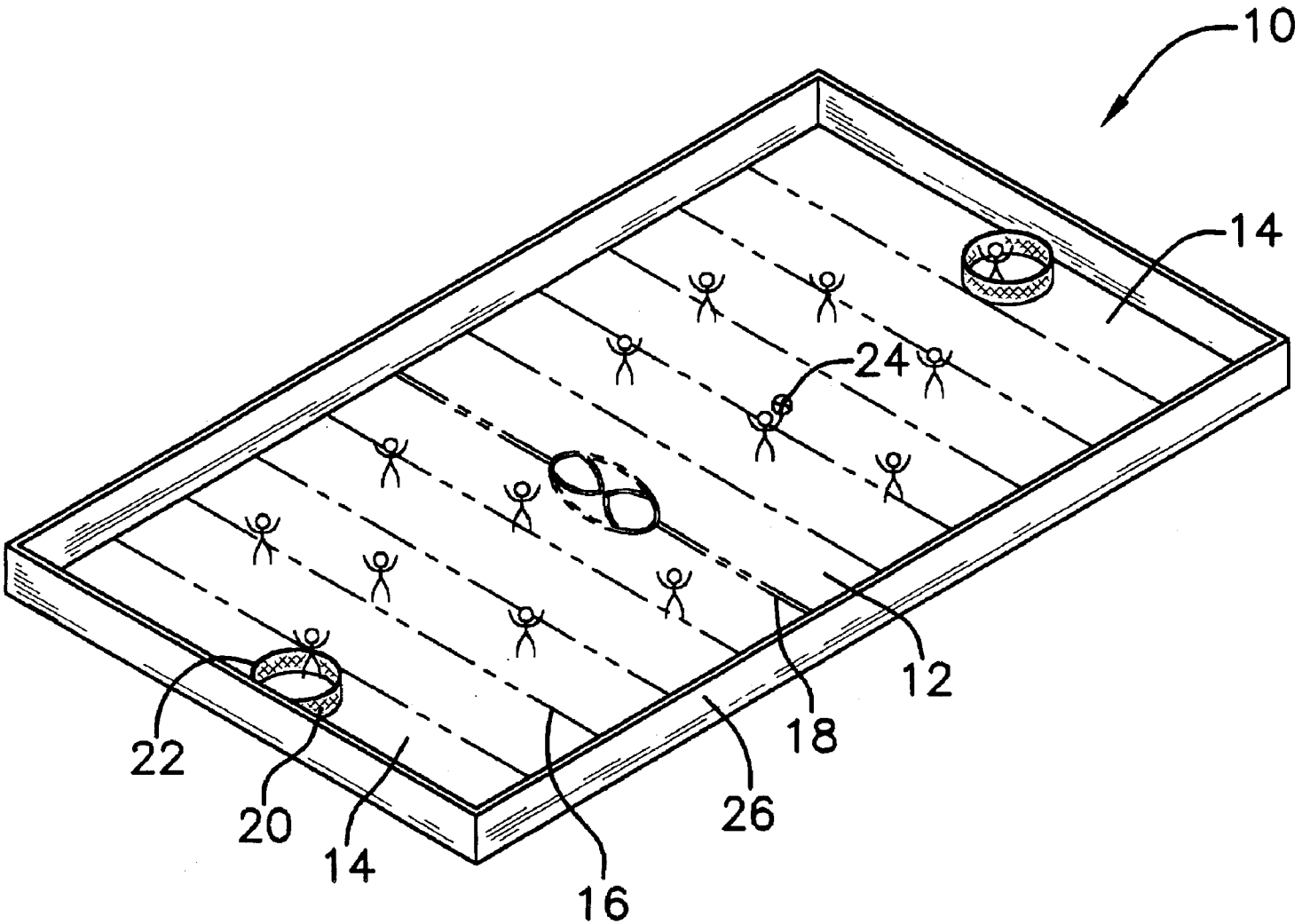
FIG. 1 is a top perspective view of the preferred embodiment of the hanet ball game and method constructed in accordance with the principles of the present invention.
Figure 2:
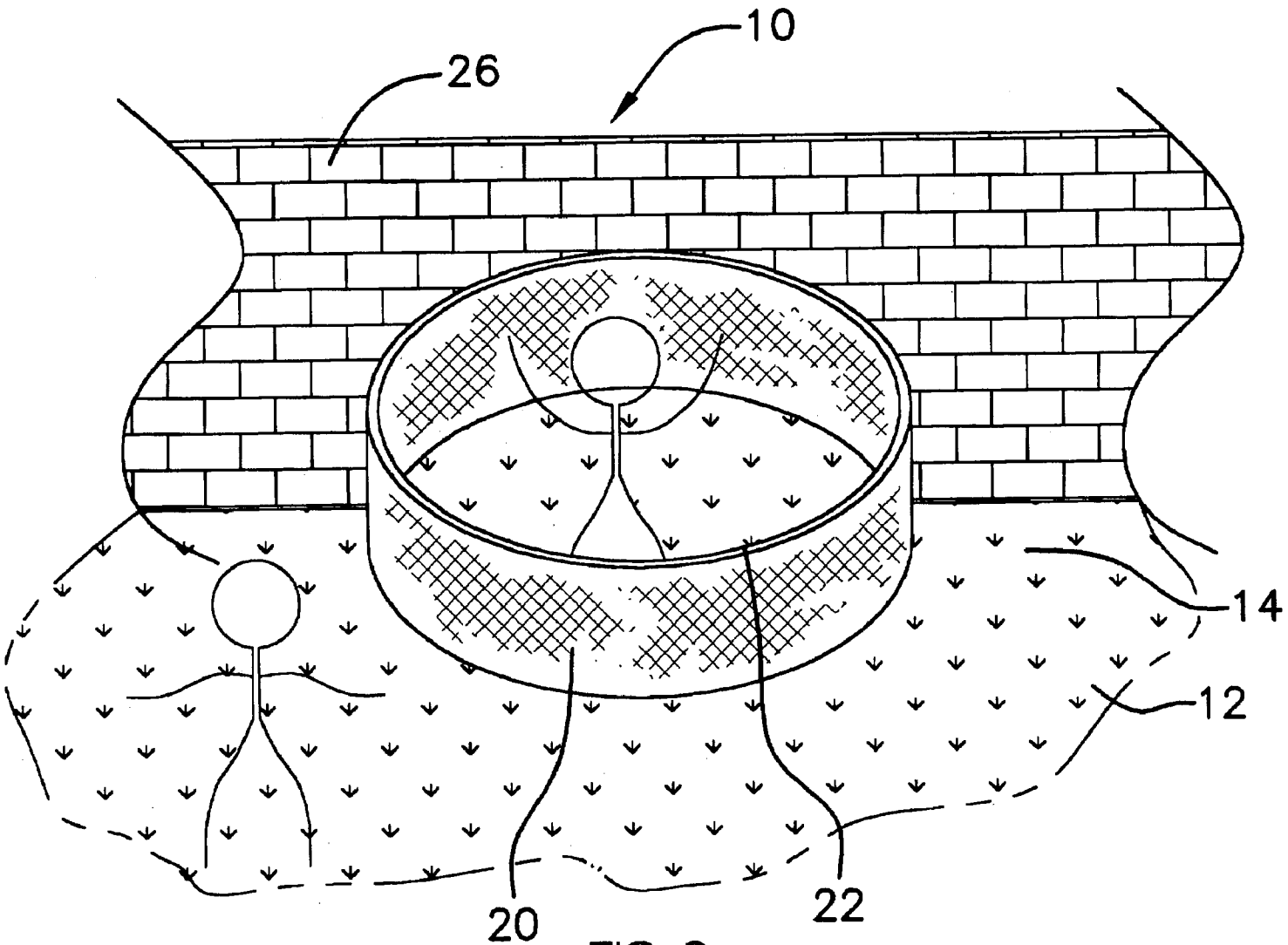
FIG. 2 is a top perspective view of the hanet ball game and method of the present invention.

Referring now to the drawings, and particularly to FIGS. 1–2, a preferred embodiment of the hanet ball game and method of the present invention is shown and generally designated by the reference numeral 10.

In FIG. 1, a new and improved hanet ball game and method 10 of the present invention for unique field type game is illustrated and will be described. More particularly, the hanet ball game and method 10 has an elongated rectangular playing field 12 that has a set of two opposite ends 14. The playing field 12 has dimensions of between 300–360 feet long by 150–300 feet wide. The playing field 12 has a set of 10 yard markers 16 along the length of the playing field 12. A ground standing tubular goal net 20 is located at both ends of the playing field 12. The goal net 20 is approximately 12 feet in diameter and 3½ tall. The tubular goal net 20 is for the goal keeper player to play within. Half way between the goal nets 20 the field is marked with a mid-field line 18. An inflatable ball 24 has the diameter of approximately 7.5 inches. A perimeter wall 26 encloses the elongated rectangular playing field 12.

In FIG. 2, the hanet ball game and method 10 is illustrated and will be described. The ground standing tubular goal net 20 is located at both ends of the playing field 12. The goal net 20 is approximately 12 feet in diameter and 3½ feet tall. The tubular goal net 20 is for the goal keeper player to play within. A circular frame 22 has the diameter of 12 feet and the height of 3½ feet connected to the goal net 20. The perimeter wall 26 encloses the elongated rectangular playing field 12.

The method of playing the hanet ball game includes selecting two opposing seven player teams. Obtaining the parts of the game. Defending the playing field with two players termed defenders, the defenders attempting to keep the ball out of play in proximity to the team goal net. Attacking opposing team with two players termed attackers, the attackers attempting to move the ball toward the opposing team goal net. Protecting the team goal net with a player termed a protector, the protector attempting to keep the ball away from the team goal net. Keeping the team goal net with a player termed a goal keeper, the goal keeper attempting to keep the ball out of the team goal net. Passing the ball within 20 seconds of possession to another member of the same team after having crossed the mid-field line. Shooting the ball within 35 seconds of possession after having crossed the mid-field line. Deducting two points from a team for each seven mistakes made. Removing a player after four mistakes are committed. Timing play of the game to seventy minutes.

While a preferred embodiment of the hanet ball game and method has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable shaped enclosed goal may be used instead of the circle described. And although unique field type game have been described, it should be appreciated that the hanet ball game and method herein described is also suitable for miniaturization for use as a toy.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hanet ball game method comprising:

obtaining the hanet ball game comprising:

an elongated rectangular playing field having two opposite ends, said playing field having dimensions of between 300 to 360 feet long by one 150 to 300 feet wide, said playing field has 10 yard markers along the length of said playing field, half way along said length defining a mid-field line on said playing field;

a ground standing tubular goal net at both of said playing field opposite ends, said goal nets termed a team goal net and an opposing team goal net, said goal net being a approximately 12 feet in diameter and 3½ feet tall, said tubular goal net for a goal keeper player to play within;

a circular frame having a diameter of 12 feet and a height of 3½ feet connected to said goal net;

an inflatable ball having a diameter of approximately 7.5 inches;

a perimeter wall enclosing said elongated rectangular playing field, selecting two opposing seven player teams;

defending said playing field with two players termed defenders, said defenders attempting to keep said ball out of play in proximity to said team goal net;

attacking opposing team with two players termed attackers, said attackers attempting to move said ball toward said opposing team goal net;

passing said ball within 20 seconds of possession to another member of the same team after having crossed said mid-field line;

protecting said team goal net with a player termed a protector, said protector attempting to keep said ball away from said team goal net; and keeping said team goal net with a player termed a goal keeper said goal keeper attempting to keep said ball out of said team goal net.

2. The hanet ball game method of claim 1 further comprising the steps of:

shooting the ball within 35 seconds of possession after having crossed said mid-field line.

3. The hanet ball game method of claim 2 further comprising the steps of:

deducting two points from a team for each seven mistakes made.

4. The hanet ball game method of claim 3 further comprising the steps of:

removing a player after four mistakes are committed.

5. The hanet ball game method of claim 4 further comprising the steps of:

timing play of said game to seventy minutes.

* * * * *